United States Patent [19]

Gibson

[11] Patent Number: 4,748,795

[45] Date of Patent: Jun. 7, 1988

[54] FILM WRAPPING MACHINE

[76] Inventor: Charles D. Gibson, 2888 Serfass Rd., Clinton, Ohio 44216

[21] Appl. No.: 896,235

[22] Filed: Aug. 14, 1986

[51] Int. Cl.[4] ..... B65B 67/00

[52] U.S. Cl. ..... 53/390; 53/502; 53/219

[58] Field of Search ..... 53/219, 390, 502

[56] References Cited

U.S. PATENT DOCUMENTS

| | | | |
|---|---|---|---|
| 1,530,977 | 3/1925 | Brady | 53/219 |
| 2,652,669 | 9/1953 | Holtz | 53/219 X |
| 2,842,910 | 7/1958 | Reed | 53/219 X |
| 3,176,443 | 4/1965 | Klamp | 53/219 X |
| 3,570,215 | 3/1971 | Palmer | 53/390 X |
| 3,800,499 | 4/1974 | Feldman | 53/390 X |
| 4,257,212 | 3/1981 | Havens | 53/219 X |
| 4,458,470 | 7/1984 | Fine | 53/502 |
| 4,524,559 | 6/1985 | Ikemoto | 53/219 |
| 4,551,962 | 11/1985 | Kawahara | 53/390 X |

*Primary Examiner*—John Sipos

*Attorney, Agent, or Firm*—Oldham, Oldham & Weber Co.

[57] ABSTRACT

A countertop wrapping machine for weighing and wrapping merchandise is disclosed. A single roll of film is supported by columns which extend upwardly from the back end of the machine. A shelf for supporting a weighing device is disposed near the bottom of the machine but high enough so that a web of film can pass thereunder. The wrapping machine also has a transverse electrically heated cutter bar with a knife edge which contacts only a small area of film. A hot plate is provided for heating portions of the film for heat sealing. One end of the roll of film is supported by a device which can be adjustably mounted on an axle to accommodate rolls of different widths. The other end of the roll may be supported by conventional means. The machine operator pulls a web of film manually along a path which extends from the film roll, under the shelf for the weighing device, and to the cutter bar.

14 Claims, 2 Drawing Sheets

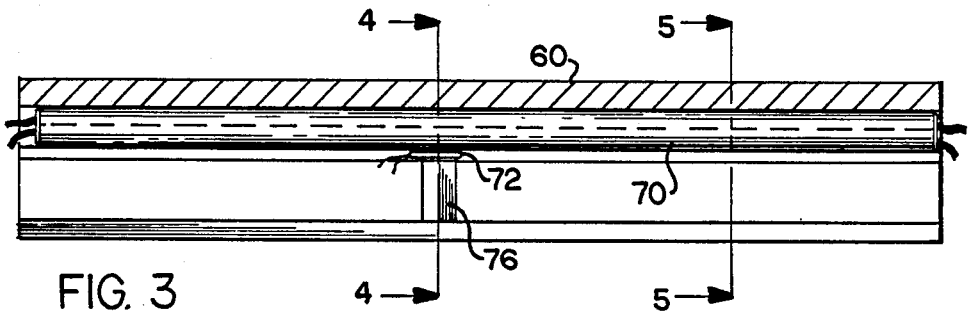
FIG. 3
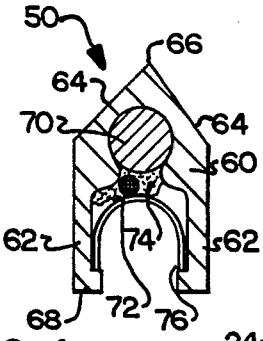
FIG. 4
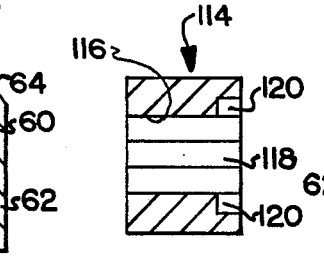
FIG. 8
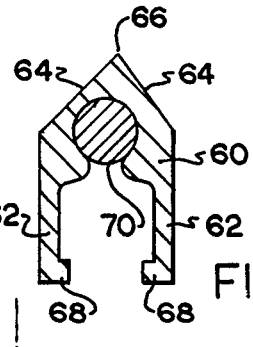
FIG. 5
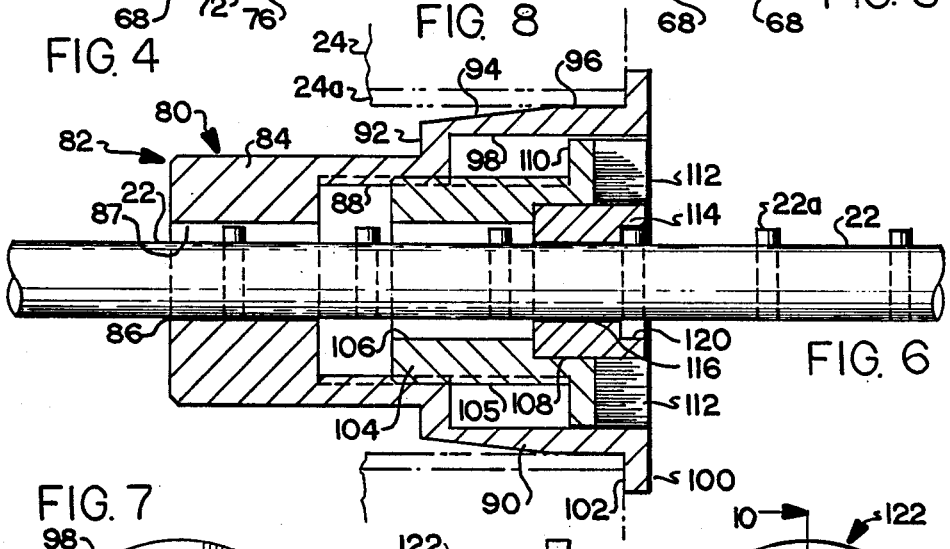
FIG. 6
FIG. 7
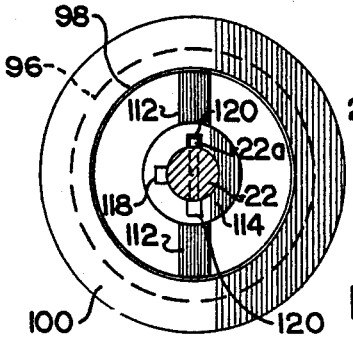
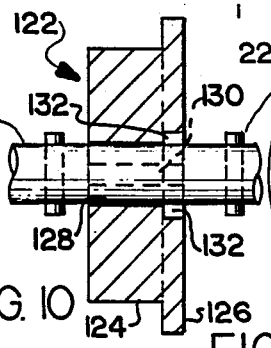
FIG. 10
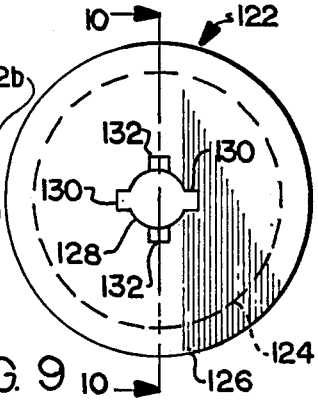
FIG. 9

FILM WRAPPING MACHINE

TECHNICAL FIELD

This invention relates to wrapping machines and more particularly to countertop wrapping machines of a type used for overwrapping a container of meat or other food with a plastic wrap.

BACKGROUND ART

Most meat sold in supermarkets is packaged in an open container or tray, overwrapped with a transparent film, weighed, and the weight printed on a label that is attached to the overwrap, in advance. Some fruits and vegetables are similarly packaged and weighed. The package is then placed in a refrigerator, showcase or on a shelf of a supermarket, where a customer may select the merchandise which he/she wishes to purchase.

Single roll wrapping machines for overwrapping food packages with plastic film are well known and are used in supermarket chains. A disadvantage of the present single roll wrapping machine is that they do not provide any space for a weighing device (e.g. a load cell or scale), which is a necessary adjunct of every food overwrapping operation. Another disadvantage of such machines is that it is difficult to transport the film from the roll to the wrapping location.

DISCLOSURE OF THE INVENTION

It is an object of this invention to provide a film overwrapping machine which permits a more compact arrangement of wrapping machine and weighing device than is the case with present single roll film overwrapping machines.

A related object of this invention is to provide a single roll film overwrapping machine which has a shelf on which a scale or load cell can be placed, so that it is not necessary to provide a separate space for the weighing device.

A further object of this invention is to provide an electrically heated film cutter having a sharp cutting edge which allows the film to be cut faster and at a lower temperature than do film cutters presently in use.

A still further object of this invention is to provide an adjustable roll supporting device for insertion into one end of a roll core, so that the wrapping machine can use films of different widths.

These and other objects are accomplished by the wrapping machine of the present invention, which comprises (a) a frame adapted to be placed on a countertop, (b) means for supporting a roll of film, (c) a shelf supported by said frame above but close to the bottom thereof and adapted to support a weighing device, (d) means for guiding a web of said film in a path which extends under such shelf and (e) transversely extending cutter means for cutting the web of said film.

This invention according to another aspect provides an electrically heated film cutter which comprises a cutting edge extending the width of the film, and an electrically heated metallic heating rod extending substantially the length of the cutting edge for heating the same, a temperature sensing device of comparatively short axial length adjacent to a portion of the heating rod for sensing the temperature thereof, and means for holding the sensing device in place.

This invention according to still another aspect provides an adjustable roll supporting device for insertion into one end of a roll core. This device comprises (a) a rotatable hollow cylindrical body member having a nose portion for insertion into one end of a roll core, a shoulder for engaging a lateral edge of the roll core, a bore forming a central passageway for an axle for extending through said supporting device and an internally screw threaded counterbore; (b) an internally screw threaded hollow adjusting nut received in said counterbore and axially movable with respect to said body member; (c) a locking device for coacting with the axle and engaging the adjusting nut to hold the body member and adjusting nut in place.

BRIEF DESCRIPTION OF DRAWINGS

This invention will now be described with reference to the accompanying drawings, in which:

FIG. 3 is a front elevational view of the electrically heated film cutter according to this invention, with parts broken away and parts shown in section.

FIG. 4 is a vertical sectional view taken along line 4—4 of FIG. 3.

FIG. 5 is a vertical sectional view taken along line 5—5 of FIG. 3.

FIG. 6 is a vertical sectional view of an adjustable roll supporting device according to this invention.

FIG. 7 is an end view of the adjustable roll supporting device shown in FIG. 6.

FIG. 8 is a vertical sectional view of the locking sleeve which forms part of the device shown in FIG. 6.

FIG. 9 is a front view of an end cap for supporting a roll of film.

FIG. 10 is a vertical section view taken along line 10—10 of FIG. 9.

BEST MODE FOR CARRYING OUT INVENTION

Figure 1:
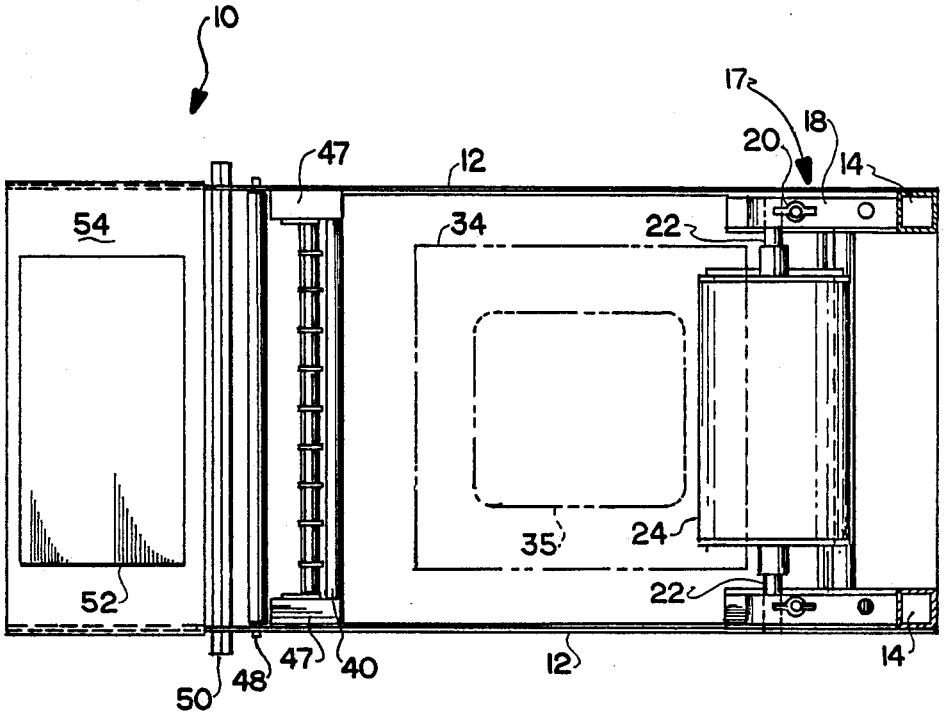
FIG. 1 is a top view of the wrapping machine of the invention with parts shown in section.
Figure 2:
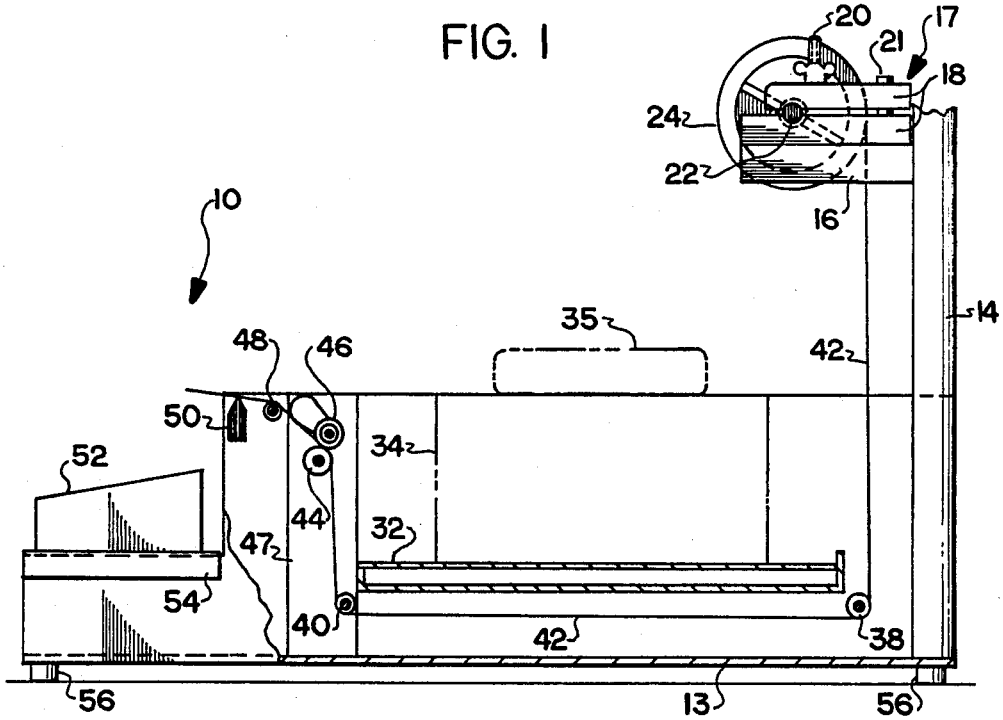
FIG. 2 is a side elevational view of the wrapping machine of this invention, with parts broken away and parts shown in section.

Referring now to FIGS. 1 and 2, 10 is a wrapping machine according to this invention. Wrapping machine 10 is a countertop device for overwrapping the package, particularly a food package, with a layer of plastic sheet or film. This wrapping machine provides a space for a weighing device as will be described hereinafter.

Wrapping machine 10 has a frame which includes a pair of spaced vertical parallel side walls 12. Sidewalls 12 may be made of sheet steel. Side walls 12 terminate at their lower ends in inwardly extending horizontal flanges 13. Sidewalls 12 extend the entire length of the machine 10. Vertical columns 14, which are hollow and of square cross-section, and also made of sheet steel, extend upwardly from the back portions of the respective sidewalls 12. Each of the columns 14 has mounted thereon a forwardly extending support arm 16 and a tension device 17 which includes a pair of spring pressed jaws 18 which are urged apart by springs (not shown) and held together by suitable means such as a screw and wing nut 20 and a bolt 21. The lower jaw in each tension device 17 rests on arm 16. An axle 22 which supports a roll 24 of film is rotatably mounted between the jaws of tension devices 17. Roll 24 is mounted on axle 22 so that the film thereon may be unwound as will be described in greater detail with reference to FIGS. 6–8. Axle 22 and roll 24 turn together.

A transverse bar (not shown) extends transversely between columns 14, at a height above the tops of sidewalls 12, to maintain columns 14 in their upright position.

A horizontal shelf (not shown), attached to the top of columns 14 may be provided above roll 24 of film if desired. Such shelf may be used, if desired, for supporting a portion of a weighing device or an accessory associated therewith, as for example a digital weight readout or a label printer.

A horizontal shelf 32 is provided for holding a weighing device 34 (shown in phantom lines) such as a load cell or a scale. The load cell or scale 34 may be a commercially available device having a label printer associated with it. Weighing device 34 may have a platform, preferably at the same height as the tops of sidewalls 12, for receiving the merchandise to be weighed and wrapped. The merchandise 35 (also shown in phanton lines) is weighed on weighing device 34. Provision of a shelf and a space for such weighing device is an important feature of this invention. Shelf 32 extends from one sidewall 12 to the other at a height above but close to the bottoms of sidewalls 12. The height of shelf 32 is sufficient so that a web of plastic film unrolled from roll 24 may pass underneath the shelf. Only a short distance above the bottom of sidewalls 12 is required for this purpose. Shelf 32 may have a pair of upturned flanges at the front and back ends and a pair of downturned flanges along the sides. The downturned flanges may be secured to sidewalls 12 by conventional means.

First and second idler rolls 38 and 40, respectively, are provided to guide the path of a web 42 of film as it is unwound from roll 24. Idler rolls 38 and 40 are at a height above the bottom of the sidewalls 12 but below shelf 32, so that the web of film passes behind and then underneath shelf 32. Web 42 travels vertically from roll 24 to idler roll 38, thence horizontally to idler roll 40, thence upwardly, and passes between a third idler roll 44 and articulating roll 46, both of which may be journaled in vertical columns 47 at a height only a short distance below the top of sidewalls 12. After the web 42 passes between idler 44 and articulating roll 46, it travels over film holding roll 48, which has a tacky surface to which the film will adhere. The path of web 42 extends generally forwardly from roll 24 to film holding roll 48. Film holding roll 48 is near the forward corner of the wrapping device 10.

An electrically heated transversely extending film cutter 50 is provided so that the operator can cut the web 42 of film to desired length. This cutter 50 will be described in detail with reference to FIGS. 3–5. Cutter 50 is located near the upper corners of sidewalls 12, just forward of film holding roll 48.

The frame of machine 10 may include additional cross bars (not shown) to provide structural rigidity.

The operator of machine 10 pulls a web 42 of film by hand through a path which begins at roll 24, extends behind and then under shelf 32, and ends at cutter 50. The aforedescribed rolls 38, 40, 44, 46 and 48 determine the path of the film.

At the forward end of machine 10 is a film heater or hot plate 52, which is supported on horizontal shelf 54. Shelf 54 may be at about the same height as shelf 32, although this is not critical. Portions of sidewalls 12 are cut away so that the forward ends thereof extend no higher than the height of shelf 54. This provides unobstructed access to hot plate 52. Hot plate 52 is provided for heat sealing of film after a portion thereof has been cut off by cutter 50.

Wrapping machine 10 is supported by legs 56, which are of short axial length and which may be rubber or plastic coated. These legs may extend downwardly from flanges 13 near the four corners of device 10.

Film cutter 50 of this invention will now be described in greater detail with reference to FIGS. 3–5. Referring now to FIGS. 3–5, film cutter 50 comprises a hollow extruded aluminum cutter bar 60, which is open at the bottom (as best seen in FIGS. 4 and 5) and which extends transversely from one sidewall 12 to the other. Cutter bar 60 comprises a pair of vertical side walls 62, and a pair of sloping surfaces 64 which intersect to form a cutting edge 66 at the top of the film cutter 50. This cutting edge 66 may be either sharply pointed or may be rounded with a small radius of curvature, but in either event it affords a small area of contact with the web 42 of the film to be cut. Cutter bar 60 also has a pair of inwardly extending flanges 68 at the bottom. A metal heating rod 70, (e.g., "Calrod"), which has electrical leads at both ends, extends virtually the entire length of housing 60. Cutter bar 60 has a cylindrical recess to receive heating rod 70. A temperature sensing device 72, e.g. a thermistor, is in contact or in close proximity with heating rod 70 at the center thereof. Thermistor 72 also has electrical leads (shown in FIG. 3). Thermistor 72 is held in place by means of a small mass of heat resistant, electrically nonconductive mass of material (e.g. a cement) 74 and a leaf spring 76. Ends of leaf spring 76 rest against flanges 68.

Cutter bar 60 may be heated to a relatively low temperature, e.g. about 200° to 230° F.

A major advantage of the cutter 50 of this invention is the small area of contact between the cutting edge 66 and the film. The sharp cutting edge results in a narrow band of heating area on the film. This, in turn, allows the film to be cut rapidly and at a low cutting temperature. It also reduces the area in which film and plasticizer buildup may occur, and reduces the chances of smoke. It is known that plastic films of the type used for wrapping become tacky when heated; surface area of film to which other objects may cling is less than the heated area of film in cutting devices now in use. Use of a heat sensor or thermistor 72 externally mounted at the center of heating rod 70 permits unencumbered use of the cutting edge 66. It also affords accurate indication of the temperature of heating rod 70, more accurate than is possible with other arrangements, so that it is possible to obtain fast, consistent film cutting and to eliminate or greatly reduce smoke and fumes.

The novel axle assembly and adjustable roll end supporting device for supporting a roll 24 of film will now be described with particular reference to FIGS. 6 through 8. This axis assembly and adjustable roll end supporting device make it possible to use rolls 24 of different widths and to change quickly from a roll of one width to a roll of a different width when all of the film on the first roll has been unwound.

Axle 22 is held in place at either end by tension devices 17, as shown in FIGS. 1 and 2. Axle 22 has a plurality of parallel pins **22*a* which project outwardly at one end thereof. Pins 22*a* may be at uniformly spaced intervals as shown in FIG. 6, or at predetermined spacings in accordance with standard film widths. Near the other end of axle 22 are a second set of parallel pins 22*b*, which project outwardly from axle 22 at both ends. These pins may also be at uniformly spaced intervals or at predetermined spacings in accordance with standard film widths. The first set of pins 22a engages an adjustable roll end supporting device 80 as will now be described with reference to FIGS. 6–8. The second set of pins 22b engages a non-adjustable roll end supporting device as will be described subsequently with reference to FIGS. 9 and 10**.

One end of roll 24 is supported by means of the adjustable roll end supporting device 80 of this invention, as shown in FIGS. 6–8. This device includes a rotatable hollow cylindrical body member 82 which has a nose portion 84 of uniform outside diameter. Nose portion 84 has a bore 86 with a keyway 87, and a screw threaded counterbore 88. Bore 86 is just slightly larger in diameter than axle 22. Keyway 87 extends the entire length of bore 86 and is deep enough to receive a pin 22a on axle 22. This arrangement enables roll 24 of film, roll end supporting device 80, and axle 22 to rotate as a unit when film is unwound. Supporting device 80 also has a radially offset portion 90, which is or larger diameter than the nose portion 84, forming a first shoulder 92 on the exterior of device 80 between the two portions. The outside surface of radially offset portion 90 includes an inwardly tapered frustaconical surface 94 and a cylindrical surface 96. Radially offset portion 90 has a second counterbore 98, which is of larger diameter than the first counterbore 88. At the outside end of body member 82 is an outwardly directed flange 100, which forms a second shoulder 102 that serves as a limit stop for a roll 24 of film. A film roll 24 wound around core 24a (shown in phantom lines in FIG. 6) is supported by device 80 with the ends of the roll against flange 100.

An externally screw threaded hollow adjusting nut 104, having external screw threads 105, is received in the internally screw threaded counterbore 88 of body member 82. Adjusting nut 102 has a bore 106, which is large enough to receive axle 22 and projections 22a thereon, and a counterbore 108 at its outer end. Also at the outer end of adjusting nut 104 are an outwardly directed flange 110 and a pair of diametrically opposite wings 112. Wings 112 are provided for hand turning of adjusting nut 104. Adjusting nut 104 moves axially with respect to body member 82 as one turns wings 112.

A locking sleeve 114 is received in counterbore 108, with its inner end against the shoulder between bore 106 and counterbore 108. This locking sleeve, best shown in FIG. 8, includes a bore 116, which is just slightly larger in diameter than axle 22 to provide a small clearance therebetween. A keyway 118 extends the length of locking sleeve 114 and communicates with bore 116. Two additional keyways 120 of very short axial length and each disposed at 90 degrees from keyway 118, are provided at the outer end of locking sleeve 114 to receive a projection 22a.

Body member 82 and adjusting nut 104 rotate with film roll 24 as film is unwound. Locking device 114 on the other hand is stationary, being held in place by a projection 22a, which is received in one of the two short keyways 120. Both the counterbore 108 of adjusting nut 104 and the outside surface of locking sleeve 114 are smooth to permit free rotation. Thus, adjustable roll end supporting device 80 is a clutch assembly.

The adjustable roll end supporting device 80 is required at only one end of roll 24. The other end may be supported by a non-adjustable roll end supporting device, which may be conventional.

A preferred non-adjustable roll end supporting device 122 is shown in FIGS. 9 and 10. Referring to FIGS. 9 and 10, this roll end supporting device 122 is an end cap comprising a cylindrical body 124 with a flange 126 at one end. The outside diameter of body 124 is just slightly less than the inside diameter of roll 24, and flange 126 is slightly larger in diameter than the inside diameter of roll 24, so that end cap 122 may be inserted into one end of roll 24 with flange 126 abutting against the edge of the roll. End cap 122 has a bore 128 and a pair of diametrically opposite keyways 130 which communicate with bore 128. Bore 128 and keyways 130 extend the entire thickness of end cap 122. A second pair of keyways 132, disposed at right angles to the first pair 130, extend just a short distance in from the outer face of end cap 122. The first pair of keyways 130 permits the end cap 122 to be removed from the second end of axle 22; the second pair of keyways 132 permits end cap 122 to engage the second set of lugs to hold the end cap in place.

When a new roll 24 of film is to be loaded, end cap 122 is removed from axle 22 by twisting 90° so that keyways 130 are aligned with the pins 22b on axle 22, and sliding the end cap off the axle. The old roll core 24a is then removed. A new roll of film 24 is inserted so that one end of the roll abuts shoulder 102 of adjustable roll end supporting device 80 as shown in FIG. 6. End cap 122 is then replaced by sliding the end cap along axle 22 until body portion 124 of the end cap enters the open end of roll 24, and turning end cap 122 90° to lock it in place. Turning the end cap brings short keyways 132 into alignment with the pins 22b on axle 22. Adjustable roll end supporting device 80 is tightened against the end of roll 24 by turning adjusting nut 104 by means of wings 112 until shoulder 102 firmly engages the end of roll 24.

A roll core 24a can be removed when the roll 24 of film is completely unwound by carrying out a sequence of steps which is the reverse of that just described for inserting the new roll.

Wrapping machine 10 is intended to be placed on a countertop, it is preferably of such size as to be suitable for countertop use.

The operation of wrapping machine 10 will now be described.

First, the merchandise 35 is weighed on weighing device 34 and the weight is printed on a label. Next, the merchandise to be wrapped is placed on the top of weighing device 34. Then the operator pulls web 42 of film manually forward, keeping the web above electrically heated cutter 50 until a length of film suitable for wrapping is forward of cutter 50. Then the operator cuts off the desired length of film with cutter 50, pulling the web down slightly so that a narrow band portion thereof touches the cutter 50. He then places the weight label on the inside surface of the film, wraps the film around the merchandise in any container or tray associated therewith and then heats the peripheral edges of the film on hot plate 52 and seals the peripheral edges together in the usual manner. Weighing and wrapping are conducted in the usual way but the physical arrangement of weighing device and wrapping location made possible by this invention is more convenient and more economical of space than arrangements now in use.

The tacky surface of film holding roll 48 holds the web 42 after a length of film has been cut off, so that the web is in tension between supply roll 24 and film holding roll 48. The free end of the web 42 of film does not snap back after a length is cut off on cutter 50.

The wrapping machine 10 of this invention offers a number of advantages over single supply roll countertop wrapping machines now in use. One of these is that it provides a place for a scale 34, which facilitates space economy and makes possible a very convenient juxtaposition between the scale 34 and the wrapping location, which is preferably just forward the forward end of device 10. By virtue of the novel cutter 50 herein employed, the machine 10 herein also makes it possible to cut a film cleanly and quickly with little or no smoke formation, utilizing a lower cutter temperature than those generally utilized at present. The wrapping machine of this invention also can use film supply rolls of different widths. Thus, the wrapping machine of this invention offers a number of advantages over countertop wrapping machines now in use.

While in accordance with the patent statutes, a preferred embodiment and best mode has been presented, the scope of the invention is not limited thereto, but rather is measured by the scope of the attached claims.

What is claimed is:

1. A countertop wrapping machine comprising:

(a) a frame adapted to be placed on a countertop;

(b) means for supporting a roll of film at a height above that of the bottom of said frame;

(c) a horizontal shelf for supporting a weighing device, said shelf being supported by said frame above but close to the bottom thereof;

(d) transversely extending cutter means for cutting the web of said film, said cutter means being mounted on said frame at a level substantially above that of said shelf; and (e) means for guiding a web of said film in a path which extends downwardly from said roll, thence horizontally under said shelf, thence upwardly to said cutter means.

2. A wrapping machine according to claim 1 further comprising means for maintaining the unrolled portion of the web of film under tension.

3. A wrapping machine according to claim 2 in which said frame includes a pair of vertical sidewalls and said means for maintaining said web of film under tension comprises a horizontal bar extending from one sidewall to the other near said cutting means and has a surface to which said film adheres.

4. A wrapping machine according to claim 1 further comprising electrical heating means for heating a portion of said film and means for supporting said heating means.

5. A wrapping machine according to claim 4 in which said heating means includes an electrically heated surface.

6. A wrapping machine according to claim 1 in which said means for supporting a roll of film comprises a pair of parallel arms extending upwardly from said frame and horizontally extending roll core engaging means supported by said arms.

7. A wrapping machine according to claim 7 in which said roll core engaging means comprises a pair of inwardly extending members, one extending from each arm, for engaging the ends of a roll core.

8. A wrapping machine according to claim 7 in which at least one of said inwardly extending members is adjustable to receive rolls of different widths.

9. A wrapping machine according to claim 1 including a shelf supported by said arms at the upper ends thereof.

10. A wrapping machine according to claim 1 in which said cutter means is electrically heated.

11. A wrapping machine according to claim 1 in which said frame extends longitudinally and includes a pair of spaced vertical parallel sidewalls, said means for supporting a roll of film comprises a pair of parallel arms extending upwardly from the rear portion of said frame and horizontally extending roll core engaging means supported by said arms, said shelf extends from one sidewall to the other, and said cutter means is located forwardly of said shelf and near the top edges of said sidewalls, said wrapping machine further includeing an electrically heated hot plate near the forward end of the machine.

12. A wrapping machine according to claim 11 in which the forward and rear edges of said shelf are near said cutter means and the back end of the frame, respectively.

13. A wrapping machine according to claim 1 in which said means for supporting a roll of film, said shelf and said cutter means are arranged longitudinally in the order named.

14. A countertop wrapping machine comprising:

(a) a frame adapted to be placed on a countertop;

(b) means for supporting a roll of film at a height above that of the bottom of said frame;

(c) a shelf supported by said frame above but close to the bottom thereof;

(d) a weighing device on said shelf;

(e) transversely extending cutter means mounted on said frame for cutting the web of said film; and (f) means for guiding a web of said film in a path which extends downwardly from said roll, thence horizontally under said shelf, thence to said cutter means.

* * * * *